United States Patent [19]

Cacicedo

[11] Patent Number: 4,913,325

[45] Date of Patent: Apr. 3, 1990

[54] NEEDLE THREADING APPARATUS

[76] Inventor: Paulino A. Cacicedo, 5 Tisbury Ct., Scotch Plains, N.J. 07076

[21] Appl. No.: 400,777

[22] Filed: Aug. 30, 1989

[51] Int. Cl.[4] ..... D05B 87/02
[52] U.S. Cl. ..... 223/99; 223/102
[58] Field of Search ..... 223/99; 112/224, 225

[56] References Cited

U.S. PATENT DOCUMENTS

| | | | |
|---|---|---|---|
| 2,213,965 | 9/1940 | Naftali et al. | 112/225 X |
| 2,525,034 | 10/1950 | Jamo | 223/99 X |
| 2,623,668 | 12/1952 | Fisher | 223/99 |
| 3,000,545 | 9/1961 | Ullisperger | 223/99 |
| 4,557,408 | 12/1985 | Biemans | 223/99 |
| 4,573,719 | 3/1986 | Aldridge | 223/99 X |

FOREIGN PATENT DOCUMENTS

| | | | |
|---|---|---|---|
| 1073840 | 9/1954 | France | 223/99 |

*Primary Examiner*—Andrew M. Falik
*Assistant Examiner*—Ismael Izaguirre
*Attorney, Agent, or Firm*—R. Gale Rhodes, Jr.

[57] ABSTRACT

Apparatus for threading a thread through the eye of a needle, including thread holder for receiving a holding a portion of the thread, needle receiver for receiving the needle and presenting the eye of the needle for threading, threader for engaging and threading the portion of the thread through and out of the eye of the needle to thread the needle, and in one embodiment holder for temporarily holding the portion of the thread threaded through the eye of the needle prior to withdrawal of the threaded needle from the needle receiver to prevent inadvertent unthreading of the needle.

6 Claims, 3 Drawing Sheets

FIG. 1
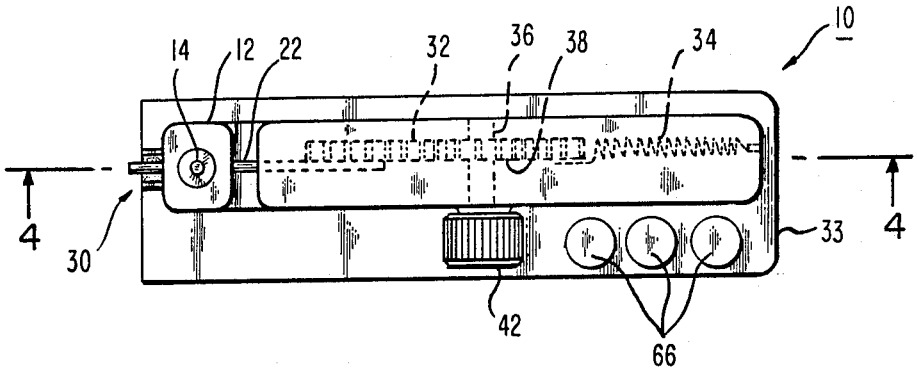
FIG. 2
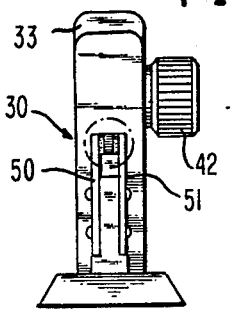
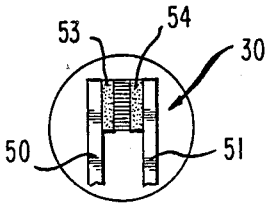
FIG. 3
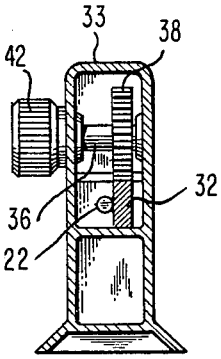
FIG. 5
FIG. 4
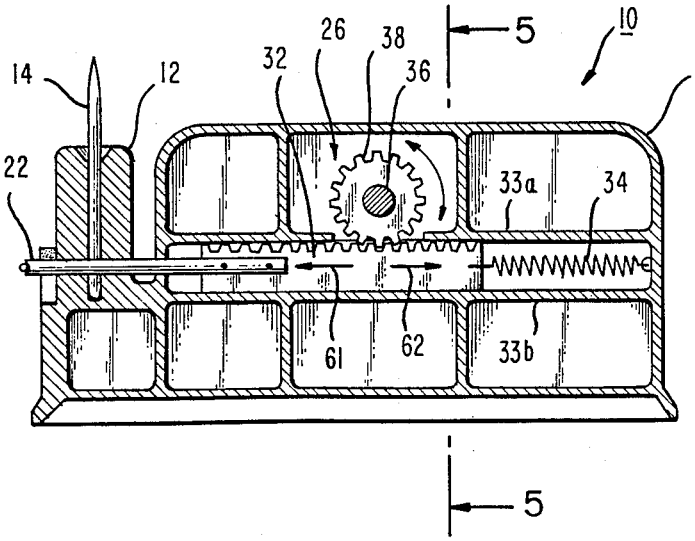

FIG. 8
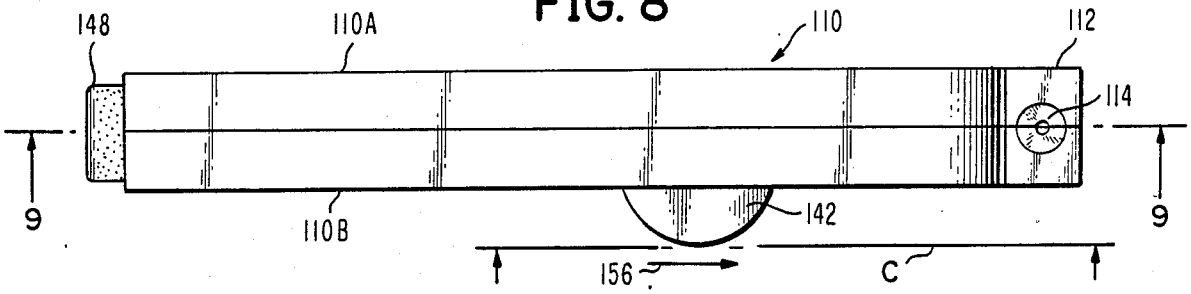
FIG. 9
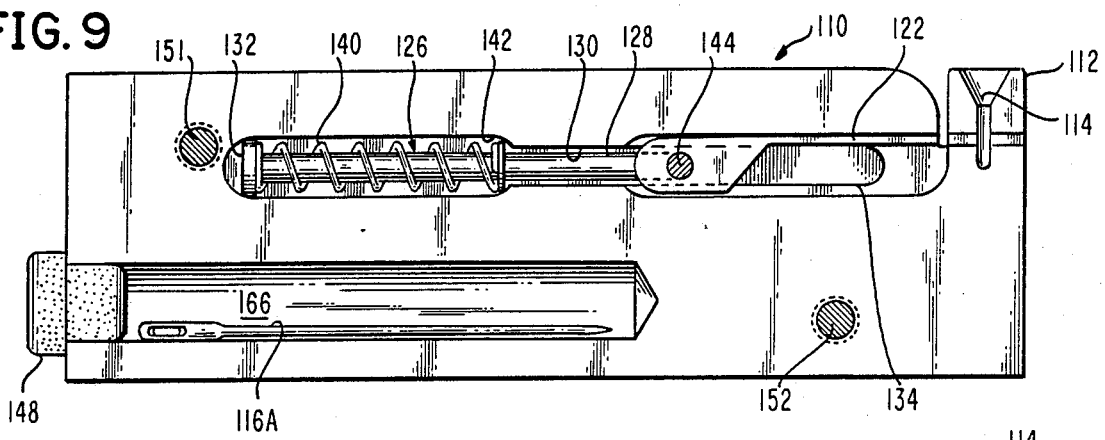
FIG. 11
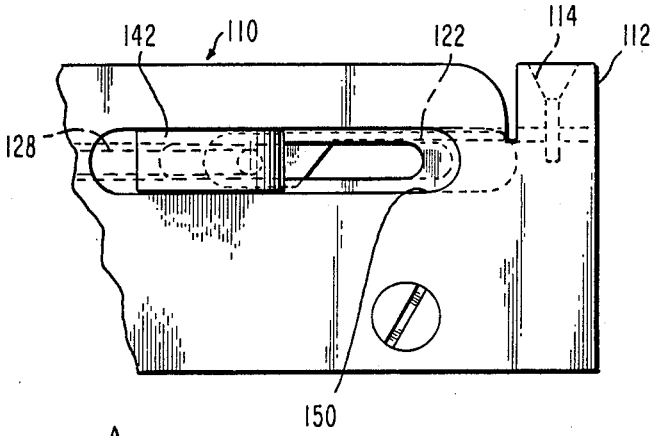
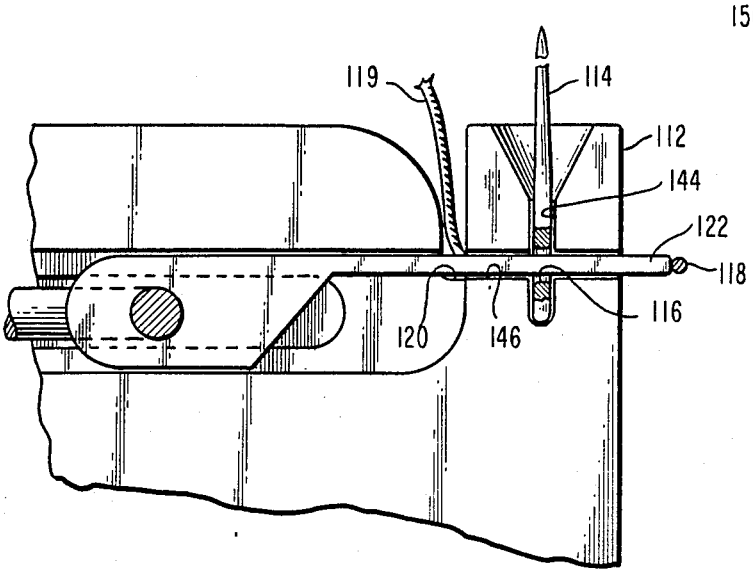
FIG. 10

NEEDLE THREADING APPARATUS

BACKGROUND OF THE INVENTION

This invention relates to new and improved needle threading apparatus.

While various needle threading apparatus are known to the prior art, there still exists a need for new and improved needle threading apparatus providing a quick and simple way to thread a needle. The present invention is especially helpful to one having difficulty seeing the eye of the needle.

SUMMARY OF THE INVENTION

The object of the present invention is to provide new and improved needle threading apparatus providing a quick and simple way to thread a needle.

Apparatus satisfying the foregoing object and embodying the present invention may include thread holding means for receiving and holding a portion of the thread to be threaded through the eye of the needle, needle receiving means for receiving the needle and presenting the eye of the needle for threading, threading means for engaging and threading the portion of the thread through the eye of the needle, and in one embodiment, holding means are provided for temporarily holding the portion of the thread threaded through the eye of the needle prior to withdrawal of the threaded needle from the needle receiving means to prevent inadvertent unthreading of the needle.

DESCRIPTION OF THE DRAWINGS

FIG. 1 is a top view of needle threading apparatus embodying the present invention;

FIG. 2 is a left end view of the apparatus of FIG. 1;

FIG. 3 is an enlarged view of the encircled portion of FIG. 2;

FIG. 4 is a vertical cross-sectional view taken generally along the line 4—4 in FIG. 1 and in the direction of the arrows;

FIG. 5 is a transverse vertical cross-sectional view taken generally along the line 5—5 in FIG. 4 and in the direction of the arrows but showing a full view;

FIG. 8 is a top view of an alternate embodiment of needle threading apparatus embodying the present invention;

FIG. 9 is a vertical cross-sectional view taken generally along the line 9—9 in FIG. 8 and in the direction of the arrows;

FIG. 10 is an enlarged partial cross-sectional view showing the needle threading finger in its forward or advanced needle threading position having threaded a portion of the thread through the eye of the needle; and FIG. 11 is a reduced partial view taken generally along the line C in FIG. 8 in the direction of the arrows.

DESCRIPTION OF THE PREFERRED EMBODIMENT

Figure 6:
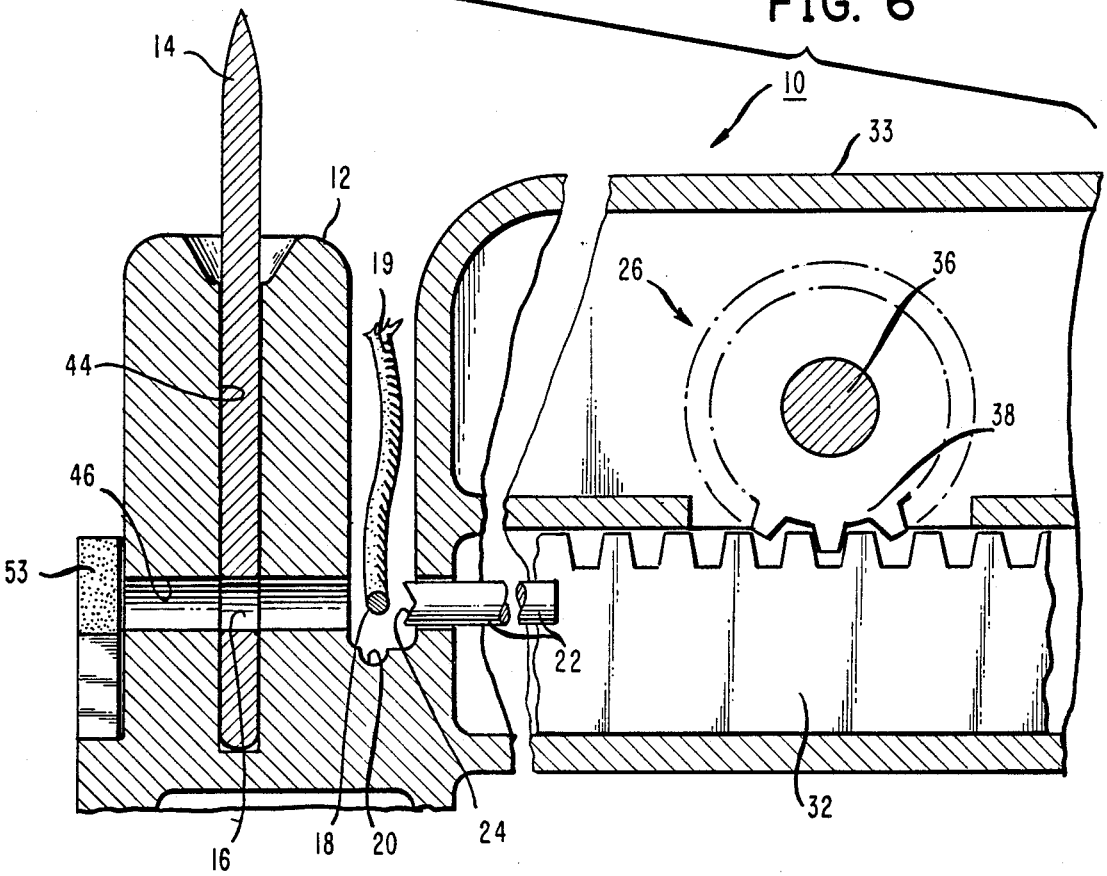
FIG. 6 is a partial vertical cross-sectional view illustrating diagrammatically the needle threading apparatus of the present invention and showing the threading finger thereof in its rearward or retracted position.
Figure 7:
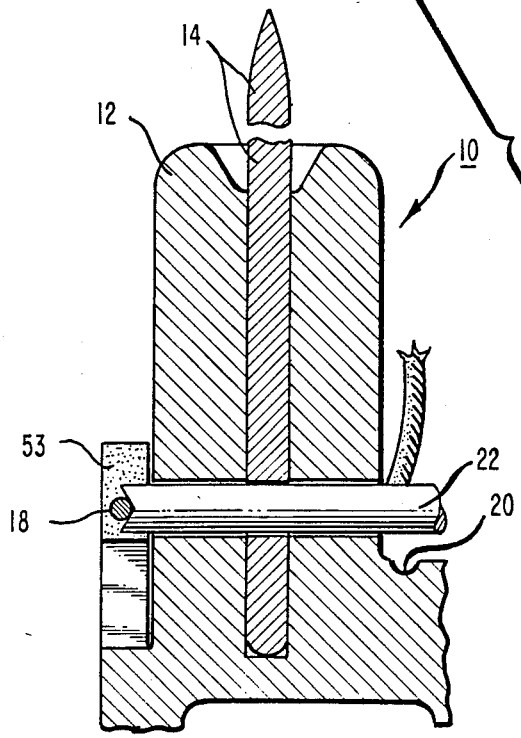
FIG. 7 is a view similar to FIG. 6 but showing the needle threading finger in its forward or advanced needle threading position having threaded a portion of the thread through the eye of the needle.

Referring now generally to the drawings, and in particular to FIGS. 1, 4, 6 and 7, needle threading apparatus embodying the preferred embodiment of the present invention is illustrated and indicated by general numerical designation 10. Generally it will be understood that the needle threading apparatus 10 includes a needle receiving member 12 for receiving the rearward portion of a needle 14 and for presenting the eye 16 (FIG. 6) of the needle for threading by the portion 18 (forward portion) of the thread 19 (FIG. 6), threading means including a threading finger 22 and advancing and retracting means indicated by general numerical designation 26 for advancing the threading finger 2 from its normal or retracted position illustrated in FIG. 6 into its forward or advanced position illustrated in FIG. 7 during which advancement of the threading finger 22 threads or inserts the forward portion 18 of the thread 19 through the eye 16 of the needle 14 and out the other side thereof as illustrated in FIG. 7, holding means identified by general numerical designation 30 (FIGS. 2 and 3) for temporarily holding the portion 18 of the thread 19 upon being threaded through the eye 16 of the needle 14 and prior to withdrawal of the threaded needle 14 from the needle receiving member 12 and thereby preventing inadvertent unthreading of the needle; and thread receiving means, i.e. groove 20 (FIG. 6) for receiving and holding the portion 18 of the thread 19 prior to threading into the eye 16 of the needle 14 by the threading finger 22.

Referring now particularly to FIG. 6, it will be understood that the needle receiving member 12 is provided with a vertical tubular passageway 44 for receiving the rearward portion of the needle 14 and a horizontal tubular passageway 46 coincident with vertical passageway 44 and for presenting the eye 16 of the needle 14 for threading.

Referring now to the threading means including threading finger 22 and advancing and retracting means indicated by general numerical designation 26, particularly FIGS. 1, 4, 6 and 7, it will be understood that the forward portion of the threading finger 22 (FIG. 6) is provided with a notch 24 for facilitating engagement of the portion 18 of the thread 19 by the threading finger and to facilitate threading of the portion 18 of the thread 19 into, through, and out the other side of the eye 16 of the needle 14 as shown in FIG. 7. Additionally, it will be understood that the advancing and retracting means indicated by general numerical designation 26 includes a gear rack 32 mounted for sliding reciprocal movement between the frame members 33(*a*) and 33(*b*) of the frame 33 (FIG. 4), a tension spring 34 having its forward portion secured to the rearward portion of the gear rack 32 and having its rearward portion secured to the frame 33 as illustrated in FIG. 4, a shaft 36 mounted suitably for rotation in the frame 33, a pinion gear 38 mounted on the rotatable shaft 36 for rotation therewith and having its teeth engaged with the teeth formed on the top of the gear rack 32 (FIG. 4), and a manually rotatable knurled knob 42 mounted on the shaft 36 for rotation therewith and in common with the pinion gear 38. As may be best seen in FIG. 4, the rearward portion of the threading finger 22 is suitably secured, such as by spot welding, to the forward portion of the gear rack 32 for movement therewith.

With particular reference to the holding means 30, FIGS. 2 and 3, it will be understood that holding means 30 includes a pair of opposed, spaced apart, holding members 50 and 51 suitably secured vertically to the frame 33 and a pair of opposed, spaced apart hook and loop type fasteners, 53 and 54 (FIG. 3) mounted on the holding members 50 and 51; hook and loop type fasteners 53 is illustrated in FIGS. 6 and 7.

In operation, it will be presumed, as illustrated in FIG. 6, that the rearward portion of the needle 14 has been placed in the vertical tubular passageway 44 of the needle receiving member 12, that the needle eye 16 has been presented for threading by the horizontal tubular passageway 46, that the forward portion 18 of the thread 19 has been placed in the groove 20 and that the needle threading finger 22 occupies its normal or retracted position shown in FIG. 6. The operator then rotates clockwise the knurled knob 42 (FIG. 1) which rotates the shaft 36 clockwise in turn rotating the pinion gear 38 clockwise to advance the gear rack 32 and the needle threading finger 22 leftwardly in the direction of the arrow 61 in FIG. 4 to advance the threading finger 22 into its forward position shown in FIG. 7 and to stretch the tension spring 34. As the needle threading finger 22 is advanced into its forward position shown in FIG. 7, the notch 24 provided in the forward portion of the needle threading finger 22 (FIG. 6) engages the portion 18 of the thread 19 and inserts or threads the portion 18 of the thread 19 through the eye 16 of the needle 14 and out the other side thereof, as illustrated in FIG. 7, whereupon the opposed hook and loop type fasteners 53 and 54 (only hook and loop type fastener 53 being shown in FIG. 7) engage the portion 18 of the thread 19 to temporarily hold the thread portion 18 and prevent the inadvertent unthreading of the needle 14 prior to its withdrawal from the needle threading member 12. After threading, and upon the release of the knurled knob 42 by the operator, the stretched tension spring 34 retracts the gear rack 32 and the needle threading finger 22 into the normal or retracted position shown in FIG. 6 by moving the gear rack 32 to the right in the direction of the arrow 62 of FIG. 4. Thereafter, the threaded needle 14 is withdrawn from the needle receiving member 12 with the thread 19 being drawn upwardly through the vertical tubular passageway 44 following the threaded needle 14.

Referring again to FIG. 1, it will be understood that the frame 33 may be provided with a plurality of holes or wells 66 for holding needles and spools of thread.

Referring now generally to FIGS. 8-11, an alternate embodiment of needle threading apparatus embodying the present invention is illustrated and indicated by general numerical designation 110. Generally it will be understood that needle theading apparatus 110 includes a needle receiving member 112 for receiving the rearward portion of a needle 114 and for presenting the eye of the needle 116 (FIG. 10) for threading by the portion 118 (forward portion) of the thread 119 (FIG. 10), threading means including a threading finger 122 (FIGS. 9 and 10) and advancing and retracting means indicated by general numerical designation 126 (FIG. 9) for advancing the threading finger 122 from its normal or retracted position illustrated in FIG. 9 into its forward or advanced position illustrated in FIG. 10 during which advancement the threading finger 22 threads or inserts the forward portion 118 of the thread 119 through the eye 116 of the needle and out the other side thereof as illustrated in FIG. 10, and thread receiving means, i.e. groove 120 (FIG. 10), for receiving and holding the portion 118 of the thread 119 prior to threading into the eye 116 of the needle 114 by the threading finger 122.

Referring now to FIG. 10, it will be understood that the needle receiving member 112 is provided with a vertical tubular passageway 144 for receiving the rearward portion of the needle 114 and a horizontal tubular passageway 146 coincident with the vertical passageway 144 and for presenting the eye 116 of the needle 114 for threading.

Referring now particularly to FIG. 9 and to the advancing and retracting means indicated by general numerical designation 126, such means includes a shaft 128 mounted for sliding reciprocal movement in a passageway 130 formed in the needle threading apparatus 110, a rearward portion provided at its rearward end with an enlarged head 132 and a forward portion 134 to which the needle threading finger 122 is suitably secured such as by welding upon the shaft 128 and threading finger 122 being made of metal. A spiral compression spring 140 surrounds the rearward portion of the shaft 128 and resides between the enlarged head 132 and a shoulder 142 providing a portion of the passageway 130. A manually operable knob 142 is suitably secured, as indicated by the stem 144 in FIG. 9, to the needle threading member 122 and hence to the shaft 128. The knob 142 resides in an opening 150 (FIG. 11) provided in the front of the apparatus 110 for reciprocal sliding movement thereon; the opening 150 opens to the exterior of the apparatus 110 and is coincident with the passageway 130.

As shown in FIG. 9, the needle threading apparatus 110 may be provided with a hole or well 166 for holding needles such as needle 116A and the well may be closed by a suitable plug or stopper 148.

Needle threading apparatus 110 may be made in halves for suitable, convenient and inexpensive manufacture, may be made of a suitable plastic, and may include two halves 110A and 110B, FIG. 8, with the halves suitably secured together such as by connecting members 151 and 152, FIG. 9, with the halves 110A and 110B and connecting members 151 and 152 suitably adhered together such as by a suitable adhesive.

In operation, it will be presumed, as illustrated in FIG. 9, that the rearward portion of the needle 114 has been placed in the vertical tubular passageway 144 of the needle receiving member 112, that the needle eye 116 has been presented for threading by the horizontal tubular passageway 146, that the forward portion 118 of the thread 119 has been placed in the groove 120, and that the needle threading finger 122 occupies its normal or retracted position shown in FIG. 9. The operator then moves or slides the knob 142 forwardly, in the direction of the arrow 156 (FIG. 8) to advance the needle threading finger 122 and connected shaft 128 forwardly, also in the direction of the arrow 156 of FIG. 8, to advance the threading finger 122 into its forward position shown in FIG. 10 and to compress the compression spring 140 between the enlarged head 132 and the shoulder 142A shown in FIG. 9. As the needle threading finger 122 is advanced into its forward position shown in FIG. 10, the forward end of the threading finger 122 engages the portion 118 of the thread 119 and inserts or threads the portion 118 of the thread 119 through the eye 116 of the needle 114 and out the other side thereof, as illustrated in FIG. 10. Upon the knob 142 being released by the operator, the compression spring 140 expands and returns the threading finger 122 and connected shaft 128 to their normal or retracted positions shown in FIG. 9. Thereafter, the threaded needle 114 is withdrawn from the needle receiving member 112 with the thread 119 being drawn upwardly through the vertical tubular passageway 144 following the threaded needle 114.

It will be understood by those skilled in the art that many modifications and variations may be made in the present invention without departing from the spirit and the scope thereof.

What is claimed is:

1. Apparatus for threading a thread through the eye of a needle, comprising:

thread receiving means for receiving and holding a portion of said thread;

needle receiving means for receiving said needle and presenting said eye for threading, said needle receiving means provided with a first vertical tubular passageway and a second horizontal tubular passageway, said passageways coincident and said first passageway for receiving the rearward portion of said needle and said second passageway for presenting said eye of the needle for threading;

threading means for threading said portion of said thread through and out of said eye of said needle to thread said needle, said threading means including a threading finger and advancing and retracting means for advancing said threading finger from a normal position into a forward position and for retracting said threading finger from said forward position into said normal position, upon said threading finger being advanced from said normal position into said forward position said threading finger engaging said portion of said thread and threading said portion of said thread through said eye of said needle; and said advancing and retracting means comprising:

(a) a gear rack having forward and rearward portions, (b) a tension spring, (c) a rotatably mounted shaft, a pinion gear mounted on said shaft and engaged with said gear rack, and (d) a manually rotatable knob mounted on said shaft, (e) said forward portion of said gear rack secured to said rearward portion of said threading finger and the rearward portion of said gear rack secured to said tension spring, said knob for being rotated manually to turn said shaft and thereby said pinion gear to cause said gear rack to advance and advance said threading finger from said normal position into said forward position, upon the advancement of said gear rack said tension spring being stretched and upon the release of said knob said tension spring retracting said gear track and returning said threading finger from said forward position to said normal position.

2. Apparatus according to claim 1 wherein said apparatus further comprises:

holding means for temporarily holding said portion of said thread upon threading through said eye of said needle and prior to withdrawal of said threaded needle from said needle receiving means to prevent inadvertent unthreading of said needle.

3. Apparatus according to claim 2 wherein said holding means comprise a pair of spaced apart hook and loop type fasteners mounted adjacent the other side of said needle receiving means, upon said portion of said thread being threaded through said eye of said needle, said hook and loop type fasteners engaging said portion of said thread to temporarily hold said portion of said thread prior to said withdrawal of said threaded needle from said needle receiving means and thereby preventing said inadvertent unthreading of said needle.

4. Apparatus according to claim 1 wherein said thread receiving means comprise a groove formed in said apparatus intermediate said needle receiving means and said forward portion of said threading finger upon said threading finger being in said normal position.

5. Apparatus according to claim 1 wherein said threading finger includes a forward portion having a notch provided therein to facilitate engagement of said portion of said thread by said threading finger and the threading of said portion of said thread through said eye of said needle by said threading finger.

6. Apparatus according to claim 1 wherein said apparatus includes an internal passageway and an opening to the exterior coincident with said passageway, said passageway including a shoulder, wherein said threading finger includes a rearward portion, wherein said advancing and retracting means comprise:

(a) a shaft residing in said passageway and having forward and rearward portions with the rearward end portion of said shaft provided with an enlarged head, said rearward portion of said threading finger secured to said forward portion of said shaft, (b) a compression spring surrounding the rearward portion of said shaft and residing between said enlarged head and said shoulder, (c) a knob residing in said opening and secured to said threading finger and said shaft, said knob for being moved forwardly in the direction of said needle receiving means to advance said threading finger from said normal position into said forward position and to compress said spring, and upon said knob being released said compression spring for expanding and retracting said shaft and said threading finger from said forward position into said normal position.

* * * * *